United States Patent [19]

Niconienko

[11] 3,996,440

[45] Dec. 7, 1976

[54] MULTIPOSITION ROTARY SWITCH WITH DETENT MEANS

[75] Inventor: Solomon Jacob Niconienko, Moorestown, N.J.

[73] Assignee: RCA Corporation, New York, N.Y.

[22] Filed: Apr. 4, 1975

[21] Appl. No.: 565,090

[52] U.S. Cl. ..... 200/155 A; 200/277

[51] Int. Cl.[2] ..... H01H 1/16

[58] Field of Search ..... 200/155 A, 155 R, 277, 200/11 R, 11 A, 11 C, 67 AA

[56] References Cited

UNITED STATES PATENTS

| | | | |
|---|---|---|---|
| 2,482,997 | 9/1949 | Andersson | 200/277 |
| 2,834,842 | 5/1958 | Le Beau | 200/277 |
| 3,534,194 | 3/1968 | Speller | 200/277 |

*Primary Examiner*—Herman Hohauser
*Attorney, Agent, or Firm*—Edward J. Norton; Joseph D. Lazar; Robert M. Rodrick

[57] ABSTRACT

A multiposition rotary switch having detent means. A retainer spring of elastic insulating material is nonrotatably mounted on a board, advantageously a printed circuit board, and a rotatable body of insulating material is positioned to rotate around a portion of the spring retainer. A plurality of conductive contact rollers are captivated between the spring retainer and the board by the elastic force of the retainer. The rollers are moved in response to manual rotation of the body to bridge in rotational sequence corresponding pairs of conductive pads suitably etched on the board to thereby make or break electrical connection between the pads of each pair. Indexing and selectively stopping the rollers to "on" and "off" positions are achieved by a plurality of detent means on the spring retainer.

12 Claims, 3 Drawing Figures

MULTIPOSITION ROTARY SWITCH WITH DETENT MEANS

The invention herein described was made in the course of or under a contract or subcontract thereunder with the Department of the Navy.

BACKGROUND OF THE INVENTION

1. Field of the Invention

This invention relates to a rotary switch and, more particularly, to a multiposition switch having detent means for positive indexing.

2. Description of the Prior Art

Rotary switches are used to make and break an electrical connection in electric circuits. Achievement of an electrical connection is generally dependent upon the mechanical interaction of the component parts of the switch. In switches utilizing rotary movement, mechanical contact and thereby electrical connection between two electrical terminals is often obtained by rolling members such as conductive balls and rollers or other curved members conducive to the rotation of the switch. Rolling contacts of the rotary type switch are used mainly because they respond to rotational movement with reduced, if not minimum, friction resulting in less wear of the component parts.

A desirable feature of rotary switches is to maintain with certainty that the switch be fixed in a set position once that position has been selected. In order to prevent inadvertent drifting of the switch out of the selected position, certain prior art arrangements employ detent mechanisms or pawling mechanisms. In general, the function of either mechanism is to develop a restraining force between interacting mechanical members, one of which is movable with respect to the other, such that the movable member is selectively locked in a fixed position. The stopping action is selective since the mechanism is arranged to allow the movable member to advance out of one position and into the next when an additional force is applied to overcome the original restraining force. The prior art devices utilizing the detent or pawling mechanisms couple these locking mechanisms to the contact means to thereby index the stopping action such that a fixed position coincides with a make or break electrical connection made.

A disadvantage of certain prior art switches is that they use complex ball or roller contacts and detent mechanisms requiring interaction of many movable mechanical members increasing the potential of failure and the reduction of reliability. Since it is required to maintain the balls or rollers in contact with the electrical terminals in the switch, the prior art devices usually provide a spring force to assure this contact. Various devices utilize a helical or leaf spring for each of the ball or roller contacts employed, whereas other devices include one spring urging a common disc or plate against the ball or roller contacts. The detent mechanisms in these devices generally comprise interacting members such as specially shaped cams, discs with single or multiple tooth-like projections, or ratchet mechanisms.

The interdependence of the spring contact means and the detent mechanism and, consequently, the need to use more parts has resulted in switches too large in size for many applications, and in particular, for printed circuit board applications. The advantage of utilizing printed circuit boards in modern technology is well-known in increased reliability, life, and compactness. Where space is a consideration in the design of an electric circuit, large switches would be inconsistent with the concept of condensation and would require compromises which would be neither necessary nor desired if a compact rotatable detent switch were available.

SUMMARY OF THE INVENTION

The present invention is directed to a multiposition rotary switch having detent means for indexing and selectively locking the switch in desired positions. A plurality of fixed pairs of electrically conductive switch contacts supported in a housing are disposed in a radial array about an axis of rotation. At least one electrically conductive roller is adapted to be revolved about the axis to make contact with each pair of switch contacts in sequence of rotation to provide an electrically conductive path between each switch contact of the pairs of contacts. Non-rotatable means for resiliently supporting the rollers is included, the non-rotatable means having means cooperating with the roller for indexing the roller relative to a selected pair of switch contacts to provide for an open or short circuit between the switch contacts of a selected pair.

DETAILED DESCRIPTION OF THE PREFERRED EMBODIMENT

Figure 1:
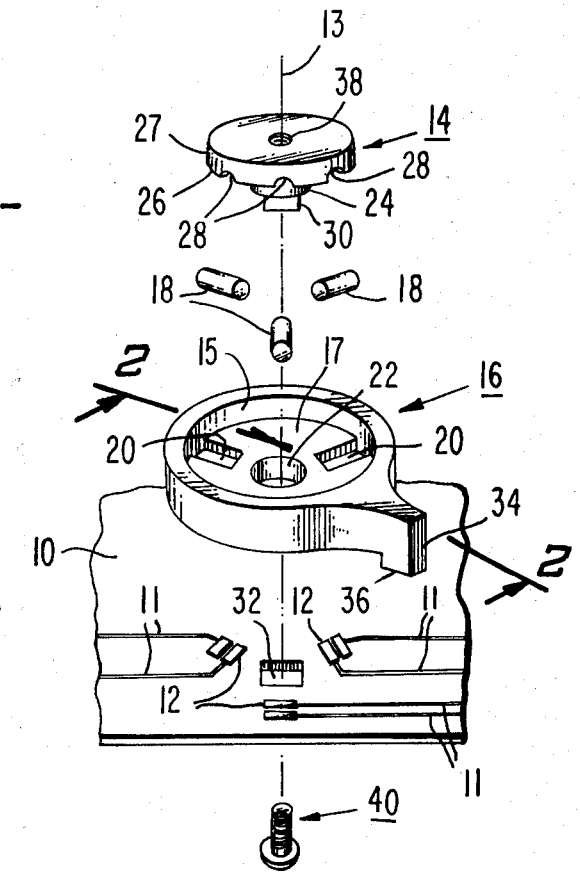
FIG. 1 is a perspective partially fragmented exploded view of the various components of a preferred embodiment of the invention.
Figure 2:
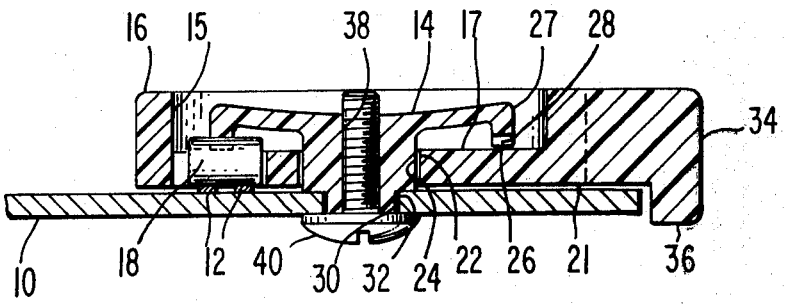
FIG. 2 is a sectional view of the preferred embodiment of the invention as assembled as seen along viewing line 2—2 of FIG. 1.

Referring to FIGS. 1 and 2, a printed circuit board 10 of nonconductive material is shown comprising a plurality of pairs of electrically conductive spaced contact pads 12. It will be understood that any suitable arrangement of electrical contacts supported in a housing for a rotary switch may be used, the preferred embodiment herein decribed being a printed circuit arrangement. The pairs of pads 12 are disposed arcuatedly about an axis 13 perpendicular to the plane of board 10 about which the rotary switch rotates. The pairs are located substantially on a common radius and preferably, but not necessarily, at equal angles to each pair. Each pad 12 of a pair is respectively connected to a printed electric circuit (not shown) as by conductive leads 11. Pads 12, leads 11, and the electric circuit are preferably etched on circuit board 10. As shown, the pairs of pads 12 represent an open electric circuit connected to leads 11. It should be noted that in its simplest form only one pair of pads 12 is etched on board 10, although the invention may be used for multiple pairs, the number of pairs being determined by the specific requirements of the electric circuit.

A plurality of conductive contact rollers 18 of cylindrical form are arranged to provide by their respective longitudinal surfaces the bridging contact across the pairs of pads 12 to make the desired electrical connections. Rollers 18 are used in the embodiment of this invention because of their rolling property as will be described. The rolling action is advantageous not only to facilitate the desired rotary movement but also to minimize wear due to friction. Rollers 18 may be formed of suitably conductive materials such as brass, copper, or aluminum.

Rollers 18 are situated on board 10 in a radial array about axis 13 and are held in contact with board 10 by spring retainer 14. Spring retainer 14 is formed of elastic insulating material an is fixedly mounted in relation to board 10. Mounting of retainer 14 may be achieved by engagement of screw 40 to threads 38 formed in the center of retainer 14. In a preferred form, retainer 14 is formed as a disc having a hub 24 at its center and a lip 26 at its rim 27. The lip 26 is provided with scallops 28 to engage the rollers 18 as will be described in detail. The diameter of rim 27 is formed to be substantially coincident with the mean diameter on which pairs of pads 12 are formed. The dimensions of spring retainer 14 and the rollers 18 are such that scallops 28 of lip 26 contact the peripheral surfaces of rollers 18 thereby to deform elastically retainer 14 about hub 24. The material of retainer 14 is selected to have a modulus of elasticity such that the resulting deformation of retainer 14 produces stresses in the material below its elastic limit, thereby preventing permanent deformation. The elastic deformation provies a force sufficient to press rollers 18 into good static and rolling contact with board 10 and pads 12. The elastic force provided by retainer 14, thus also maintains rollers 18 captivated between lip 26 of retainer 14 and board 10.

Figure 3:
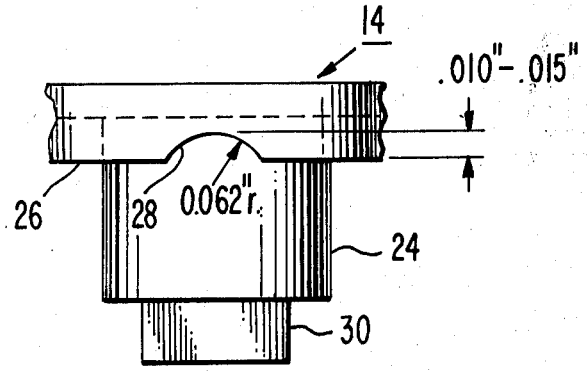
FIG. 3 is a fragmentary elevation view illustrating the configuration of a preferred form of detent means.

Scallops 28 have a radial portion preferably conforming substantially to the diameter of rollers 18. Scallops 28 are formed preferably to a depth of about 10 to 15 mils in lip 26 as shown in FIG. 3 which depth is sufficient to hold rollers 18, suitably of 0.125 inch diameter, in a fixed position within scallops 28 while the spring force is applied by retainer 14. As rollers 18 rest in scallops 28 the deformation of retainer 14 provides a sufficient spring force to press rollers 18 into contact with board 10. In order to move rollers 18 out of a set position and into another, it is necessary, therefore, to apply an additional force to rollers 18. By exerting a sufficient force through the rotation of a body 16 formed to revolve rollers 18 about axis 13, as will be described, rollers 18 will be pushed out of the scallops 28 they are in, will advance radially along lip 26 of stationary retainer 14, further elastically deforming retainer 14, until rollers 18 reach another set of scallops 28, where rollers 18 then become stopped again. By orienting scallops 28 substantially with the angular locations of conductive pads 12, a stopping action is provided at a position where the electrical connection is made. Further orienting other scallops 28 at angular positions intermediate the locations of pads 12 provides for a stopping action where the electrical connection is broken, since rollers 18 are stopped on nonconductive board 10.

Rotatable body 16 is formed of insulating material having an aperture 22 at its center to receive hub 24 of retainer 14 before retainer 14 is mounted to board 10, such that body 16 is freely rotatable around hub 24. In a preferred embodiment, body 16 is counterbored to a dish-shaped member having inner vertical annular wall 15 and inner horizontal surface 17. The diameter of inner wall 15 is larger than the diameter of rim 27 and the inner horizontal surface 17 is formed to lie on a plane between lip 26 and the surface of board 10 when body 16 is positioned on retainer 14 and when rollers 18 are held in scallops 28. Mounting retainer 14 to board 10 in its fixed position captivates body 16 between lip 26 and board 10. Since the clearance between lip 26 and inner surface 17 permits movement of body 16 in the axial direction, it is preferable to form inner surface 17 such that the distance to lip 26 is small to thereby minimize the movement of body 16 in the axial direction.

Formed in body 16 to allow rollers 18 to contact board 10 and pads 12 are a plurality of elongated apertures 20 disposed radially from the center axis 13 through inner surface 17 and bottom surface 21. Preferably, apertures 20 are rectangular dimensioned to receive therethrough rollers 18 with small clearances. Besides being captivated between retainer 14 and board 10, rollers 18 are thereby maintained in the desired radial and angular positions by the location of rectangular apertures 20. The positions of apertures 20 are located to coincide substantially to the radial and angular location of the pairs of pads 12 such that periodic registration of apertures 20 to pads 21 occurs upon rotation of body 16. Apertures 20 are also formed such that a longitudinal surface portion of each of rollers 18 contacts a pair of respective radially positioned pads 12 when rollers 18 are held within apertures 20 and when apertures 20 are in register with pads 12. Thus, the captivation of rollers 18 within apertures 20 provides for bridging of contact pads 12 as body 16 rotates. In response to the rotational movement of body 16, as by manipulation of lever 34, rollers 18 are pushed in an arcuate path on and off the pairs of pads 12 and are pressed against pads 12 and board 10 by the elastic force of retainer 14. By forming both retainer 14 and body 16 of insulating material, the only conductive paths across the pairs of pads 12 are provided by rollers 18. Therefore, the rotation of body 16 moving the rollers on and off pads 12 closes and opens an electrical conduction path between the pads 12 of each pair.

To effect the orientation of the detent means of spring retainer 14 to pads 12, spring retainer 14 is fixedly mounted to board 10 in a predetermined position. This is achieved by providing hub 24 with a noncircular key 30 to be seated in a matching aperture 32 through board 10. Preferably, key 30 and aperture 32 are formed to a shape of a square, such that when mounted, the flat mating sections prevent rotation of retainer 14. From this fixed position, scallops 28 and pads 12 are oriented at coincident angular positions to provide stopping detent actions where the electrical connection is made. Other scallops 28 are oriented intermediate the scallops 28 coinciding with pads 12 to provide for a stopping action on nonconductive board 10 portions where the electrical connection is broken. Noncircular configurations such as D shapes and triangular shapes may also be used to maintain retainer 14 in a stationary position and orient the detent means.

To facilitate the movement of rollers 18 out of fixed detent positions and to minimize the wear due to prolonged usage, it is preferable that spring retainer 14 have a low coefficient of friction in addition to having the insulating and elastic properties as described previously. Materials such as nylon, delrin, and polycarbonate are suitable for this application although other materials possessing the required properties may be used.

Body 16 may be formed of a transparent material to permit a visual indication of the electrical connections. Since this transparent material must also be insulative, a clear acrylic is preferable, and other suitable materials such as clear polycarbonate and clear delrin may also be used. However, body 16 may be formed of opaque material when used with an appropriate indicator referenced to the "on" and "off" positions.

In another form of the invention, body 16 is provided with a lever 34 for ease of activating the switch, as described above. When the switch is mounted close to an end surface of board 10 such that lever 34 overhangs the edge of board 10, lever 34 may be provided with an extension 36 projecting into the plane of board 10. Where full rotation is not a requirement, extension 36 serves as a mechanical stop to prevent overtravel of the switch, lever 34 with extension 36 being arranged to allow the desired contacts in the arc of travel thereby permitted by the mechanical stop.

It is now to be appreciated that switching to predetermined and thus indexed "on" and "off" positions is achieved by this invention. A device embodying this invention also fills a need for multiposition rotary switches which have detent means and are of low profile and compact size. Switches of this type are mounted to a printed circuit board, one sixteenth inch thick, in a space of 0.88 inch square on the board and approximately 0.30 inch deep, including the board. For this particular size switch, various multipositions are available, the switch capable of being used as a six-pole, single-throw device, or as many as a three-pole, double throw switch.

Various modifications of this invention can be made as will be appreciated by those skilled in this art. Further, the function of each of the rollers 18 may be achieved with a ball if the configuration of the pads 12 allow for a bridging of a respective pair of pads 12 to effect the electrical short. It will be appreciated that the use of a ball to effect this action would not be effective if the pads 12 are of the etched or printed circuit type, but rather an explicit pad of significant thickness.

What is claimed is:

1. A multiposition rotary switch comprising in combination: a housing for supporting a plurality of fixed pairs of electrically conductive switch contacts disposed in a radial array about an axis of rotation, at least one electrically conductive roller adapted to be revolved about said axis to make contact with each pair of said switch contacts in sequence of rotation to provide an electrically conductive path between each switch contact of said pair of contacts, and non-rotatable means for resiliently supporting said roller, said non-rotatable means having means cooperating with said roller for indexing said roller relative to a selected pair of switch contacts to provide for an open or short circuit between the switch contacts of said selected pair.

2. A multiposition rotary switch comprising a board, a stationary spring retainer of elastic insulating material mounted on said board, a rotatable body of insulating material positioned to be rotated around a portion of said retainer, a plurality of conductive contact rollers captively maintained between said spring retainer and said board, said spring retainer formed to provide an elastic retention force for maintaining said rollers captive, said board having a plurality of pairs of electrical contact pads, said contact pads disposed arcuately on said board, each pad of said pairs respectively adapted to be connected to an electric circuit, means responsive to the rotation of said body for arcuately moving said rollers into bridging contact with said pairs of contact pads to provide an electrical conduction path between each pad of a respective pair, a plurality of detent means on said spring retainer cooperating with said rollers for indexing and selectively locking said rollers on and off said contact pads.

3. A rotary switch according to claim 2, wherein said means to move said rollers into bridging contact with said pads comprises a plurality of rectangular apertures formed through said body and dimensioned to receive said rollers with close clearances, said apertures formed to coincide substantially with the radial and angular positions of said contact pads.

4. A rotary switch according to claim 2 further comprising a lever formed on said body for actuating said switch, said lever having an extension to strike the edge of said board when said switch is actuated, said switch being mounted near the edge of said board, and said projection serving as a mechanical stop to prevent overtravel of said switch.

5. A rotary switch according to claim 2, wherein said body is formed of transparent material to permit visual indication of bridging contact of said rollers on said pads.

6. A rotary switch according to claim 2, wherein said material of said spring retainer is elastically deformable, low coefficient of friction, insulating material selected from the group consisting of nylon, delrin, and polycarbonate.

7. A rotary switch according to claim 2, wherein said mounting of said spring retainer on said board includes screw means.

8. A rotary switch according to claim 2, wherein said rollers are cylindrical.

9. A rotary switch according to claim 2, wherein said rollers are spherical, said contact pads being dimensioned and arranged to cooperate with each of said spherical rollers to effect said conduction path.

10. A rotary switch according to claim 2, wherein said board is a printed circuit board, said electric circuit, said pairs of contact pads and said connections from said pads to said electric circuit being etched on said printed circuit board.

11. A rotary switch according to claim 2, wherein said spring retainer is formed as a disc having a hub at its center and a lip at its rim, said rim being substantially coincident with said arcuate position of said pads, said plurality of detent means comprising a plurality of scallops formed in said rim, said scallops having a radial section formed to mate substantially with the diameter of said rollers, a portion of said scallops substantially coinciding with said contact pads and a portion of said scallops located intermediate said contact pads.

12. A rotary switch according to claim 11, further comprising a noncircular aperture formed through said board, a key on said spring retainer formed to mate with said noncircular aperture in said board to maintain said spring retainer in a fixed position with respect to said board, said scallops being oriented from said fixed position to provide stopping positions coincident with said contact pads and stopping position intermediate said contact pads, said noncircular mating thereby preventing rotational movement of said retainer and maintaining fixed relative positions.

* * * * *